US006702932B1

(12) United States Patent
Tscherwitschke

(10) Patent No.: US 6,702,932 B1
(45) Date of Patent: Mar. 9, 2004

(54) ELECTROPLATING BARREL

(75) Inventor: Richard Tscherwitschke, Leinfelden-Echterdingen (DE)

(73) Assignee: Richard Tscherwitschke GmbH, Leinfelden-Echterdingen (DE)

( * ) Notice: Subject to any disclaimer, the term of this patent is extended or adjusted under 35 U.S.C. 154(b) by 0 days.

(21) Appl. No.: 09/959,390

(22) PCT Filed: Apr. 6, 2000

(86) PCT No.: PCT/EP00/03057

§ 371 (c)(1),
(2), (4) Date: Oct. 24, 2001

(87) PCT Pub. No.: WO00/66814

PCT Pub. Date: Nov. 9, 2000

(30) Foreign Application Priority Data

Apr. 28, 1999 (DE) ..... 199 19 344
Nov. 26, 1999 (DE) ..... 199 57 045

(51) Int. Cl.[7] ..... C25D 17/20
(52) U.S. Cl. ..... 204/213; 204/214; 204/215
(58) Field of Search ..... 204/213, 214, 204/215

(56) References Cited

U.S. PATENT DOCUMENTS 4,018,427 A 4/1977 Marulli

FOREIGN PATENT DOCUMENTS

| | | |
|---|---|---|
| DE | 17 57 412 | 12/1957 |
| DE | 11 19 623 | 12/1961 |
| DE | 27 29 525 | 1/1979 |
| DE | 30 19 719 | 12/1981 |
| DE | 39 40 920 | 6/1990 |
| DE | 196 44 775 | 4/1997 |
| DE | 198 01 675 | 7/1999 |
| EP | 0 173 094 | 3/1986 |
| WO | WO 97 12 080 | 4/1997 |

*Primary Examiner*—Arun Phasge
(74) *Attorney, Agent, or Firm*—Paul Vincent

(57) ABSTRACT

The invention relates to an electroplating barrel whose barrel shell consists of a plurality of plastic shell elements (11) which are firmly interlinked across the circumference of the shell by gluing or welding without preheating. The shell elements (11) facilitate the production of polygonal barrel shells (10) of different cross-sections. To this end, the shell elements (11) have respective integrally formed rib-shaped projections (16 and 18), whose outer surfaces (21, 22) form between them an angle α. The sides of said angle intersect in the barrel axis a-a and the degree of angle is determined, for example, for a maximum number of shell elements (11) that are to be firmly interlinked. The profile of the rib-shaped projections (16, 18) is chosen in such a manner that in the present case the angle α can be increased to produce an electroplating barrel from a smaller quantity of shell elements (11) by machining the rib outer surfaces (21, 22).

15 Claims, 6 Drawing Sheets

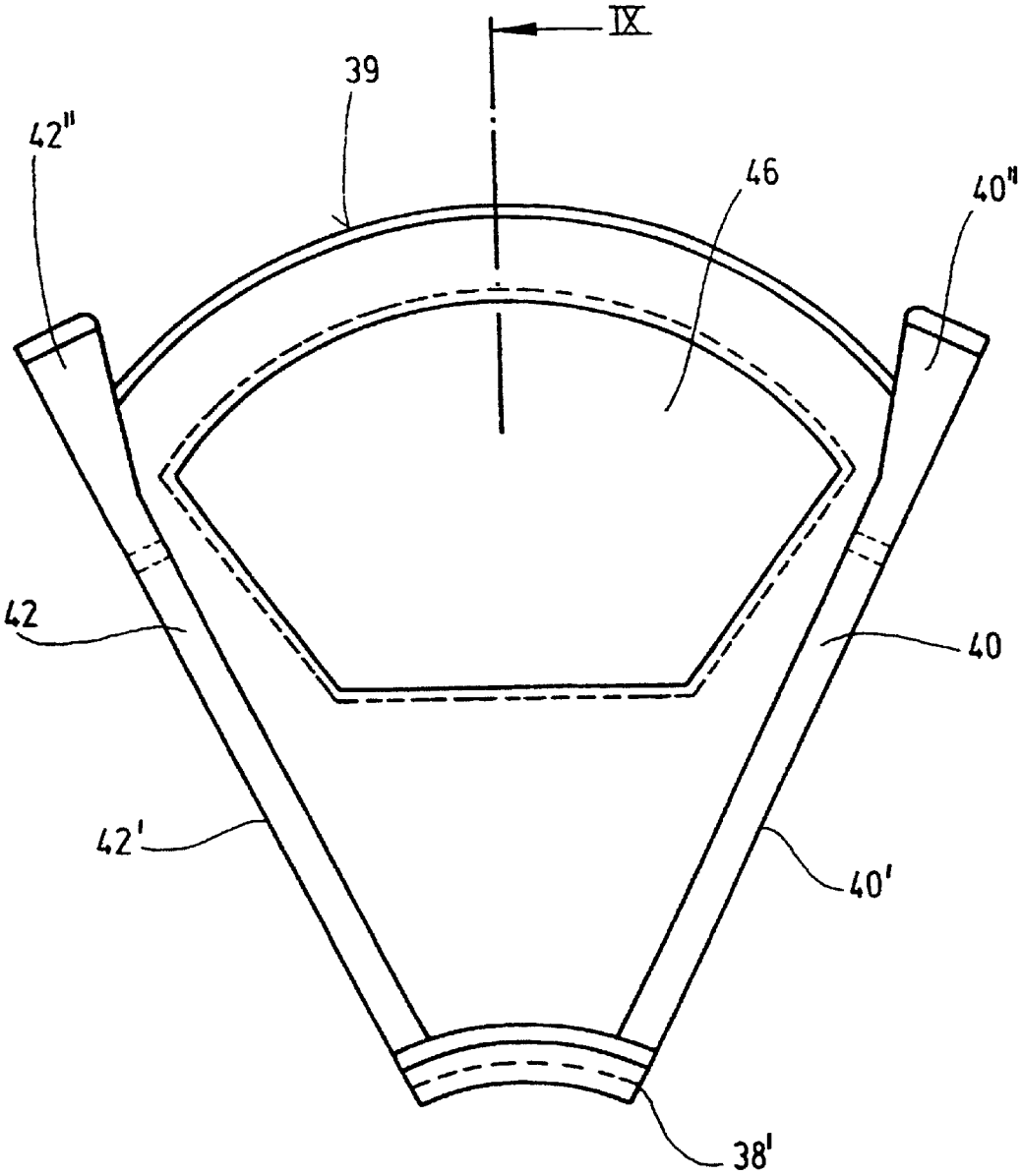
Fig. 8
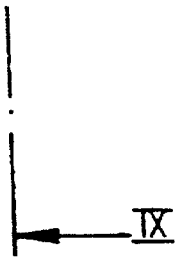

ELECTROPLATING BARREL

BACKGROUND OF THE INVENTION

The invention concerns an electroplating barrel having a perforated barrel shell with a peripheral barrel opening which can be closed by a lid, and with a cylindrical peripheral shape of non-circular cross-section, and being formed from a plurality of perforated plastic shell elements having a square shape when projected onto a plane, radially with respect to the barrel axis a-a, and which are each connected to another by one longitudinal rib at their longitudinal sides extending parallel to the barrel axis a-a.

In electroplating barrels of this type, each longitudinal side of the plastic perforated shell elements, which form the barrel shell, is welded to one longitudinal plastic rib, each extending in the axial direction of the barrel. Usually, the polygonal barrel shell has a hexagonal cross-section and the longitudinal edges of the shell elements must be correspondingly bevelled to be welded over a large area to the longitudinal connecting rib (see DE-OS 30 19 719 A1).

The production of such a barrel shell is therefore time-consuming since the longitudinal ribs must be butt welded along each of their longitudinal sides to one shell element using heat reflectors, requiring two welding processes for each longitudinal rib.

This barrel construction has the serious disadvantage that barrel volumes of different sizes require shell elements with correspondingly differentiated transverse front ends.

It is therefore the underlying purpose of the present invention to provide an electroplating barrel, which does not require the usual welding processes for mutual connection of their shell elements, and which permits modification of the volume of the barrel shell to a certain degree without adjustment of the transverse front end size of the shell elements or with shell elements of the same width.

SUMMARY OF THE INVENTION

This object is achieved in accordance with the invention in that each longitudinal rib is formed by two rib-shaped projections, which are connected to each other through gluing or cold welding, which are attached to a longitudinal side of a neighboring shell element, and which define an outer rib surface, wherein the outer rib surface subtends an angle $\alpha$ whose legs intersect on the barrel axis a-a and whose angular size is defined by a number of shell elements which are to be rigidly connected to one another, wherein the cross-section of the rib-shaped projections is such that the angle $\alpha$ can be changed appropriately for producing an electroplating barrel having a different number of shell elements through machining of the outer rib surfaces.

The longitudinal rib connecting the two neighboring shell elements of this barrel construction is divided into two rib-shaped projections which are each formed on one of the two longitudinal sides of the shell elements. Connection of the rib-shaped projections of neighboring shell elements can therefore be realized in one single working step through gluing or so-called cold welding (application of a solvent for dissolving the plastic material), wherein conventional bevelling of the longitudinal edges of the shell elements in connection with a longitudinal rib can be completely omitted.

The cross-section of the rib-shaped projections is thereby selected such that the barrel shells can be produced with different cross-sections or cross-sectional shapes. The cross-section of the rib-shaped projections or of the angles defined by the outer surfaces of these ribs is selected such that lateral joining of shell elements produces a desired barrel shell size, as defined by e.g. seven shell elements.

If barrel shells are to be produced having a smaller number of shell elements or with correspondingly smaller volume, only the outer surface of the rib-shaped projections must be changed e.g. by milling, to correspondingly increase the angle which they define.

The invention therefore permits mutual orientation of shell elements of identical cross-section at different angle settings to permit production of barrel shells of different cross-sectional shapes from identically formed shell elements, wherein the initial shape of the shell elements may be such that machining of the rib-shaped projections permits assembly of barrel shells with a smaller or larger number of shell elements.

In a preferred embodiment of the insertion, the rib-shaped projections form longitudinal ribs projecting outwardly from the barrel shell which are interconnected across an entire rib height. This has the advantage that they can be clamped together, using a clamping device, for mutual connection using a glue or a solvent for softening the outer surface of the ribs to achieve a homogeneous mutual connection.

Advantageously, the outer surfaces of the ribs of each shell element of a barrel shell design in accordance with the invention subtend an angle of approximately 60° which converges in the direction of the barrel interior. This is advantageous for applying a clamping tool to clamp neighboring rib-shaped projections.

To avoid indentations in the outer surfaces of the ribs of the shell elements produced during injection molding, provision of a channel in the rib-shaped projections is proposed which produces favorable wall thicknesses for the rib-shaped projections. In this embodiment, the rib-shaped projections have a substantially rectangular cross-section and can be penetrated in the longitudinal direction by a channel whose cross-sectional shape matches the cross-section of the longitudinal ribs. In a further development of the rib-shaped projections a sealed metal core is inserted into the channel. This guarantees that these cannot yield during mutual clamping.

The perforated wall of the shell elements may be flat. In a preferred design, the perforated wall part of the shell elements, which is disposed between the rib-shaped projections, is outwardly curved about an axis which is parallel to the barrel axis a-a. The outwardly curved wall is advantageous in that the barrel content optimally passes closely by the anode of the electroplating bath during rotation of the barrel. In addition, flat parts which are to be electroplated are thereby prevented from sticking to the inside wall of the shell elements.

The convex wall curvature in connection with the rib-shaped projections formed on the side of the shell elements produces rib-like elevations on the inner circumference of the barrel along each shell line to ensure good material circulation.

In one shell element design, transverse braces are formed on the outside of the shell elements, which bridge the separation between the rib-shaped projections of the shell elements. Each front end of the shell elements can be flush with one of the transverse braces. This is advantageous in that the perforated wall can be produced with appropriately small thickness and less material thereby providing sufficient stability.

The thickness of the transverse braces is advantageously selected such that the shell elements can be separated along a transverse center of a brace. Joining and homogeneous connection of the front ends of the shell elements, and optionally of an appropriately shortened shell element, in the direction of the barrel axis permits production of barrels of desired, stepped lengths, wherein shell elements of identical format can always be used together with only one, appropriately shortened, shell element.

The maximum length of the shell elements will thereby advantageously be selected such that their length can accommodate the smallest barrel length of a barrel production program.

The perforation of the shell elements is advantageously in the form of a slit, wherein the slits are preferably placed at separations from one another. A slitted perforation of this type has a particularly favorable effect on the electron flow during electroplating when the slits extend in the circumferential direction of the barrel.

In accordance with a preferred embodiment of the invention, the shell elements are formed in one piece from polymer (PUR). The perforated wall part of the shell elements can be formed from polymer (PUR) and their lateral rib-shaped projections from another thermoplastic material. Either the complete shell elements or merely their perforated wall part can be injected from a polymer to guarantee long service life. In the latter case, their lateral rib-shaped projections can be produced from a less expensive thermoplastic material, preferably polypropylene or polyethylene. The cross-section of the wall part and rib-shaped projections must then be such that the rib-shaped projections can be injected with the wall part in a form-locking fashion. Combination of different thermoplastic materials, such as e.g. polymer (PUR) and polyethylene for rib-shaped projections and perforated wall parts of the shell elements is generally regarded as advantageous for electroplating barrels.

The combination of the above-mentioned plastic materials has the following advantage:

Electroplating barrels are usually produced from only one single plastic material, i.e. polypropylene or polyethylene. This has the disadvantage that the perforations in the barrel shell narrow or become largely blocked after a period of time due to the presence of small particles or objects circulating in the barrel, which often have sharp edges. The present combination of plastic materials eliminates this severe disadvantage of the electroplating process.

In a further embodiment of the invention, the plastic barrel front walls are formed of sector-shaped front wall parts which are sidewardly connected to one another through gluing or cold-welding and form together a central bearing hub. This permits advantageous production of relatively large barrel front wall surfaces using a relatively small injection mold, which can be produced at low cost. Formation of the sector-shaped front wall from a number of sector-shaped front wall parts which corresponds to the number of shell elements, is advantageous in that each of their lateral rib-shaped projections can be made to coincide with one front surface of the longitudinal ribs of the barrel shell formed by the lateral rib-shaped projections and connecting thereto when gluing or cold welding each barrel front wall to a front end of the barrel shell.

In a preferred construction of the front wall parts, the sides of the front wall parts have an integrally formed rib-shaped projection, and neighboring rib-shaped projections are glued or cold-welded to form a longitudinal rib, wherein the longitudinal ribs project radially outwardly beyond the front wall parts at the barrel periphery and cover longitudinal ribs formed by the rib-shaped projections of the shell elements at the front end of the barrel. Analog to the shell elements, the rib-shaped projections can be formed of the same plastic material or of a different thermoplastic material than the front wall parts.

The proposed design of the barrel front walls is particularly advantageous when they are perforated over at least a portion of their wall surface. In this case, the injection tool must only be provided with corresponding projections for forming perforations throughout a relatively small surface region.

BRIEF DESCRIPTION OF THE DRAWING

The drawing shows embodiments of the invention.

FIG. 8 shows a sector-shaped front wall part for forming the barrel front walls;

DESCRIPTION OF THE PREFERRED EMBODIMENTS

Figure 1:
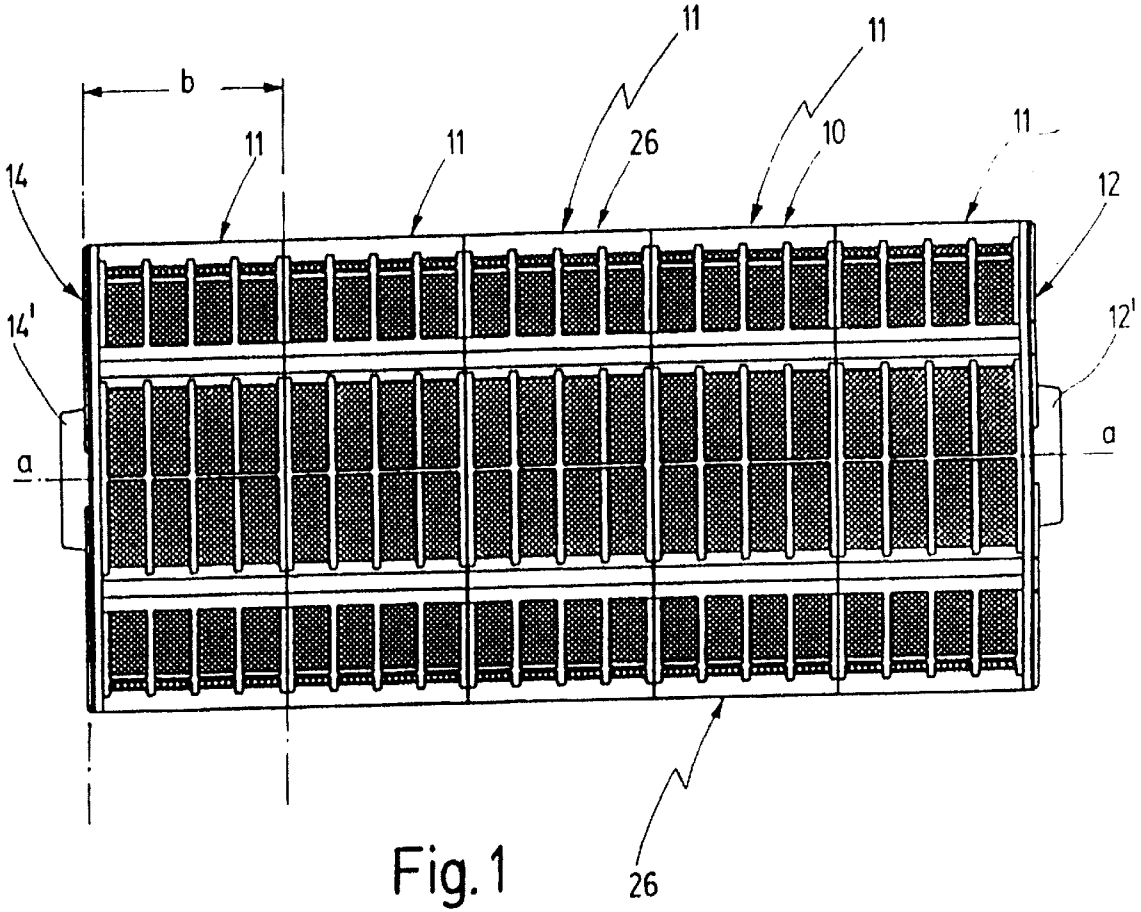
FIG. 1 shows a side view of an electroplating barrel.
Figure 2:
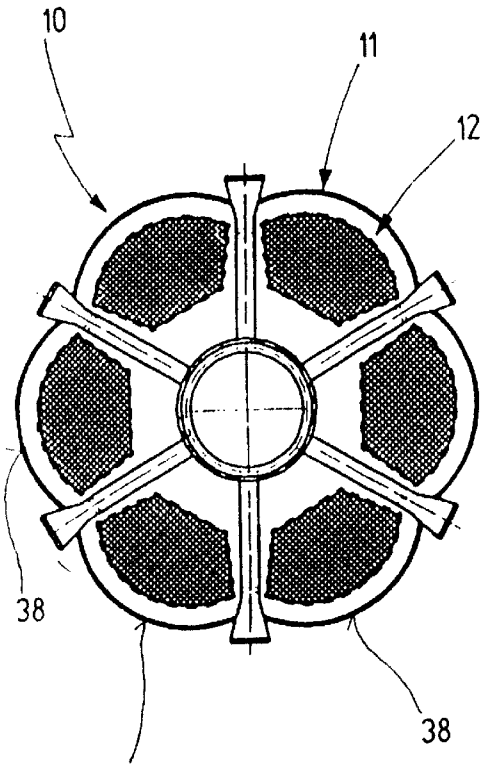
FIG. 2 shows an end view of the electroplating barrel according to FIG. 1.

The electroplating barrel according to FIGS. 1 and 2 comprises a barrel shell 10 which is formed e.g. of a plurality of shell elements 11 made from plastic material, in particular polymer (PUR) and which are interconnected at their longitudinal and front ends through gluing or cold welding. One of such elements is shown in the top view of FIG. 3.

The periphery of the barrel shell 10 is conventionally provided with a lid which can be removed from the barrel for introducing and removing material to be electroplated.

Each front end of the barrel shell 10 is closed by one respective barrel front end 12 and 14 which are also glued or cold-welded thereto and each of which having one barrel bearing hub 12' and 14', respectively. The construction of these barrel front walls 12,14 is described in detail below. The barrel front walls can also be produced as a molded body, in one piece.

Figure 3:
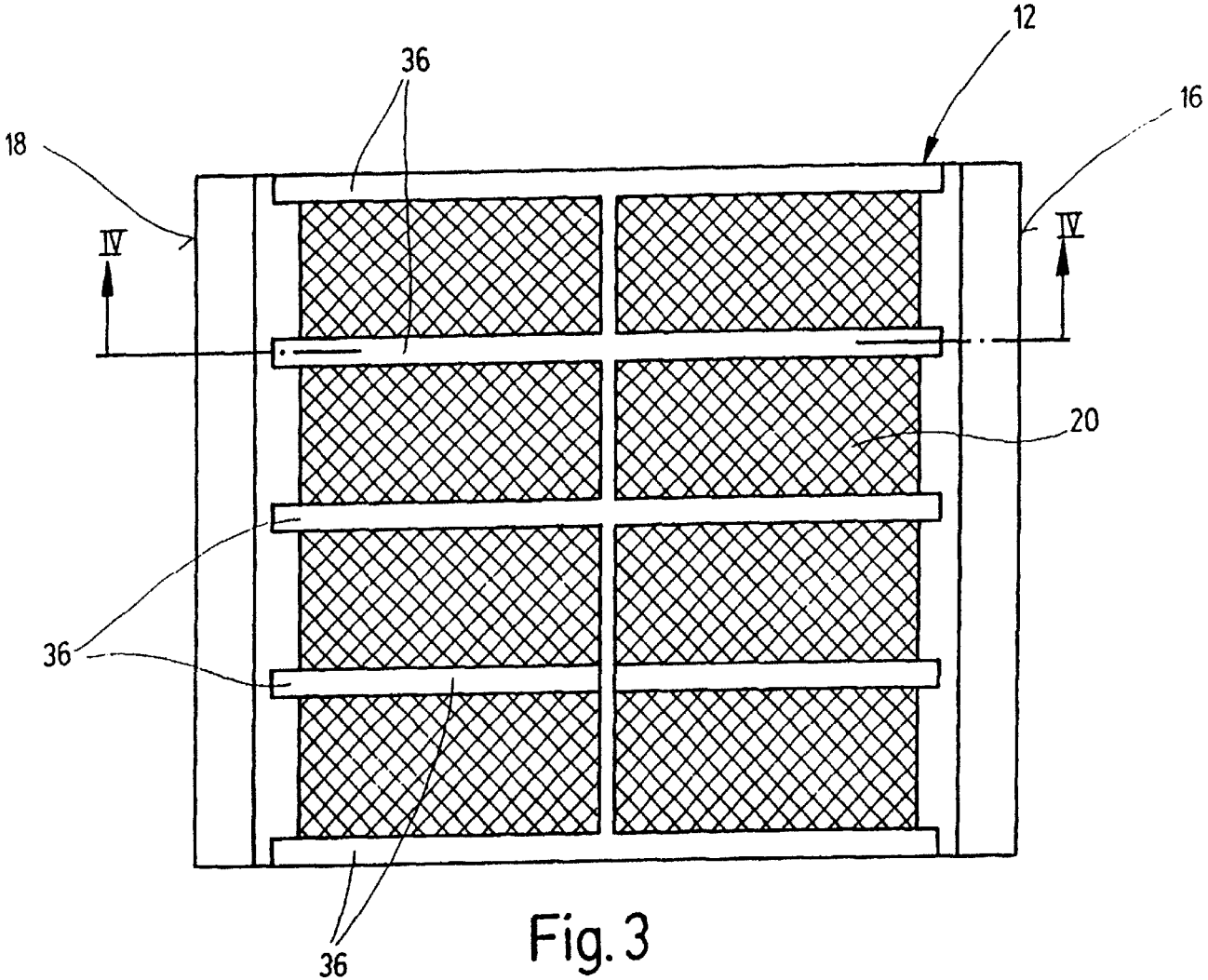
FIG. 3 shows a top view onto a shell element of the electroplating barrel.

The shell elements 11 have a rectangular shape when projected onto a plane, radially with respect to the barrel axis a-a. The two longitudinal sides thereof, which extend parallel to the barrel axis a-a, are each provided with a rib-shaped projection 16 and 18 which project outwardly from the shell element 11 in a bar-like manner (FIG. 3).

The length of the shell elements 11 can correspond to the total length of a barrel shell. Their length preferably corresponds to a minimum barrel length such that for one desired barrel length, several such shell elements 11 can be joined at their front walls (see FIG. 1).

In this case, the individual shell elements 11 have an axial length b which would permit production of a polygonal barrel shell 10 of a minimum length b from shell elements 11 rigidly connected to one another in the circumferential direction of the barrel.

Figure 5:
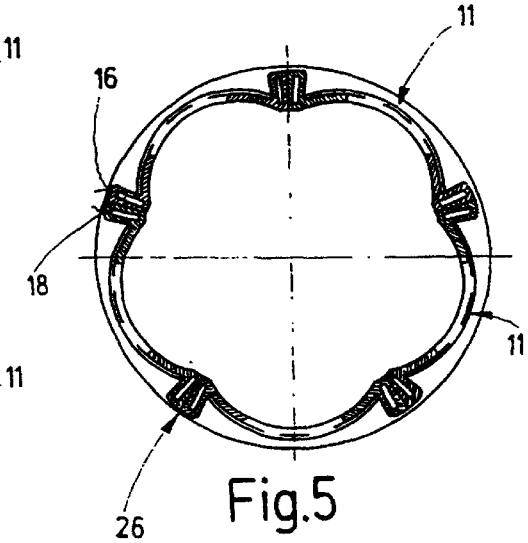
FIG. 5 shows a cross-section through a barrel shell having a first volume and assembled from shell elements of identical size.

The barrel shell 10 can comprise flat perforated shell wall parts 20. In the present case, these are preferably convexly curved toward the outside about an axis which is parallel to the barrel axis a-a (FIG. 5).

The cross-section of the rib-shaped projections 16,18 is selected to produce polygonal barrel shells of different barrel cross-sectional sizes or different numbers of shell elements 11.

Figure 7:
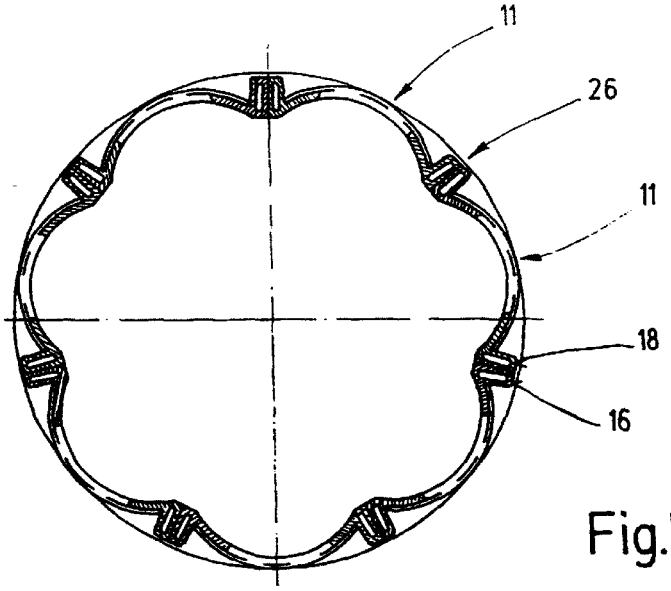
FIG. 7 shows a cross-section through a barrel shell having a third volume and assembled from shell elements having the same size as those of FIGS. 5 and 6.
Figure 6:
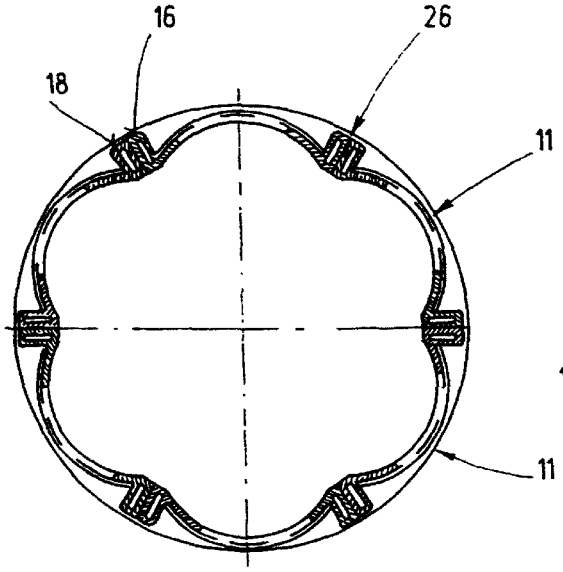
FIG. 6 shows a cross-section through a barrel shell having a second volume and assembled from shell elements having the same size as those of FIG. 5.

Towards this end, the cross-section of the rib-shaped projections 16,18 is hereby selected such that corresponding finishing of the flat outer surfaces 21 and 22 of the ribs, based on a maximum possible number of e.g. seven shell elements 11 (FIG. 7), permits production of barrel shells having e.g. only 5 or 6 shell elements 11 (FIGS. 5 and 6), wherein all these barrel shells require only one single injection mold for one single shell element 11.

In the present embodiment, the rib-shaped projections 16,18 have a rectangular cross-section and project outwardly beyond the barrel circumference. The projecting part of the rib-shaped projections 16,18 thereby serves for applying a clamping tool for clamping the outer rib surfaces 21,22 of the rib-shaped projections 16,18 to be rigidly connected e.g. by gluing.

In the finished injected state, the two flat outer rib surfaces 21,22 define an angle $\alpha$, whose legs intersect on the barrel axis, of e.g. 55° for producing a barrel shell from a total of seven shell elements 11. If the number of the shell elements 11 should be reduced as e.g. explained above, the angle $\alpha$ must be correspondingly increased through machining, e.g. milling, of the outer rib surfaces 21,22, for e.g. five shell elements 11 to 75°, and for e.g. six shell elements 11 to 65°.

The angle $\alpha$ can also be selected such that subsequent reduction thereof permits production of barrel shells with a correspondingly larger number of shell elements.

Figure 4:
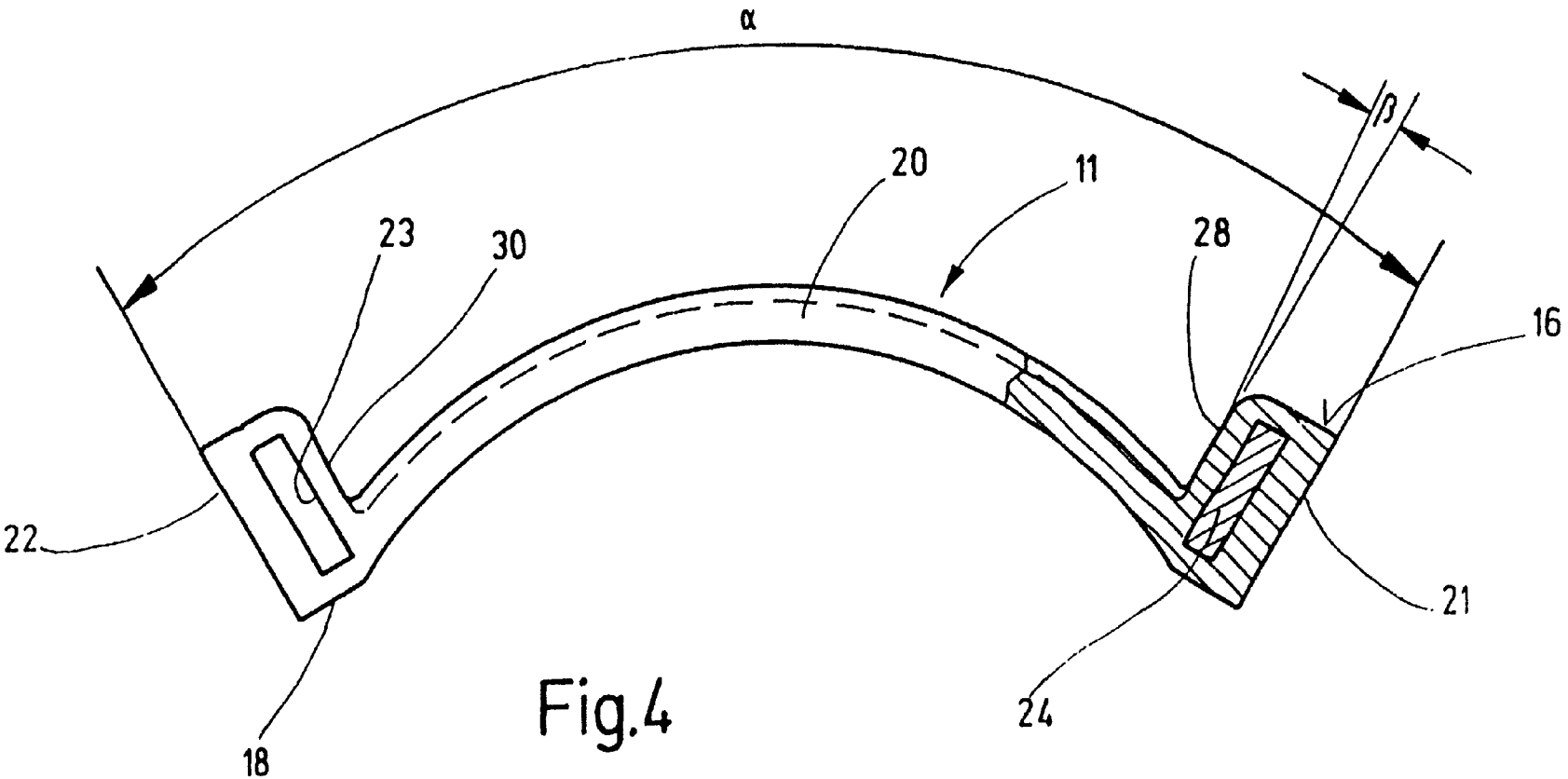
FIG. 4 shows a cross-section through the shell element along line IV—IV of FIG. 3.

FIG. 4 shows that one channel 23 passes through each rib-shaped projection 16,18 in the longitudinal direction, into which a sealed core is inserted made e.g. of flat iron 24. This measure prevents so-called indentations on the outer rib surfaces 21,22 during injection of the shell elements 11 and simultaneously provides transverse reinforcement of the rib-shaped projections 16,18 for clamping neighboring rib-shaped projections 16,18 to be glued or cold-welded together.

This figure also shows that the flat inner surfaces 28 and 30 of the rib-shaped projections 16,18 are inclined toward the inside, preferably at an angle $\beta$ of approximately 12°. This cross-sectional shape of the rib-shaped projections 16,18 is favorable for receiving the clamping device.

To save material for the production of the convexly curved shell wall part 20, i.e. make the wall correspondingly thin, e.g. five transverse braces 36 are formed on the outside thereof and are disposed at identical separations, parallel to each other, and which bridge the separation between the two rib-shaped projections 16,18. The two outer braces 36 are flush with the front end of the shell elements 11.

This permits abutment and gluing together of several shell elements 11 to obtain a desired barrel length. The shell wall part 20 is preferably perforated by slits displaced at separations from each other which extend in the circumferential direction of the barrel.

When the rib-shaped projections 16,18 of the shell elements 11, which are glued or cold-welded to one another, are shaped in a sufficiently inward manner, they form longitudinal ribs on the inner circumference of the barrel which promote circulation of the material to be electroplated. The cross-sectional shape of the shell elements 11 also permits advantageous arrangement of the barrel lid by engagement thereof and corresponding fastening between two shell elements in an automatically adjusting fashion, analog to the mutual arrangement of the shell elements 11. In a preferred construction variant of the shell elements 11, only their shell wall part 20 is injected from polymer (PUR) and their lateral rib-shaped projections 16,18 are injected from a conventional thermoplastic material, e.g. polypropylene (PP) or polyethylene, to reduce costs. In this case, one of the parts 16,20 and 18,20 to be connected is preferably provided with undercut longitudinal grooves to obtain a form-locking mutual connection of these parts during the injection process.

Figure 9:
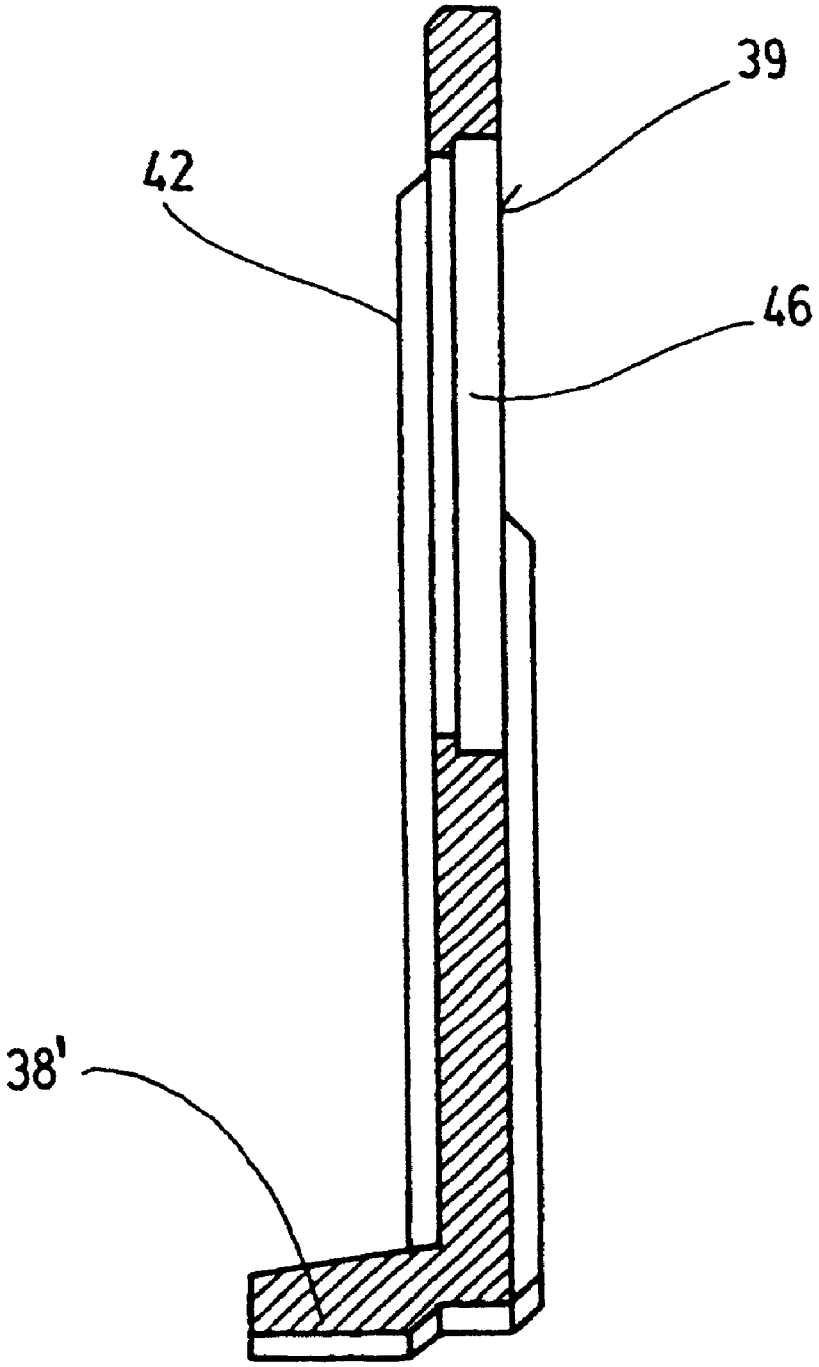
FIG. 9 shows a section through the front wall part along line IX—IX of FIG. 8.

The barrel front walls 12,14 can be produced from a plurality of identical sector-shaped front wall parts 39 which are laterally glued or cold-welded (FIGS. 8 and 9) and which each bear a sector-shaped part 39' of the bearing hub 12' and 14'. Rib-shaped projections 40,42, which are suitably provided with a core, are formed on their sides, each having a flat outer surface 40' or 42' with which they can be glued or cold-welded to an outer surface of a rib-shaped projection 40 and 42 of a neighboring front wall part 39.

When mounting the barrel front walls 12,14 to the front walls of the barrel shell 10, the radially outwardly projecting end pieces 40" and 42" of the radial ribs of the barrel front walls 12,14 formed by interconnected rib-shaped projections 40,42 thereby cover the front ends of the longitudinal ribs 26 of the shell. 46 designates a perforated surface part of the front wall parts 39.

I claim:

1. An electroplating barrel having a perforated barrel opening which can be closed by a lid, the barrel comprising:

a perforated barrel shell having a substantially cylindrical peripheral shape of non-circular cross section, said shell formed from a plurality of perforated plastic shell elements, said elements having a rectangular shape when flatted, each shell element having a first rib-shaped projection disposed at a first edge of said shell element and a second rib-shaped projection disposed at a second edge of said shell element which is opposite to said first edge, wherein said first and second rib-shaped projections define outer rib surfaces, with each rib-shaped projection being glued or cold-welded to a rib-shaped projection of a neighboring shell element at said outer rib surfaces to define ribs extending substantially parallel to a longitudinal axis of the barrel, said outer rib surfaces subtending an azimuthal angle $\alpha$ with respect to said longitudinal barrel axis, said angle $\alpha$ having a size defined by a number of shell elements spanning a circumference of the barrel, wherein each rib-shaped projection has a cross section which can be machined at said outer rib surfaces to appropriately change said angle $\alpha$ to produce an electroplating barrel having a different number of said shell elements.

2. The electroplating barrel of claim 1, wherein said rib-shaped projections form longitudinal ribs projecting outwardly from the barrel shell which are interconnected across an entire rib height.

3. The electroplating barrel of claim 1, wherein said rib-shaped projections have a substantially rectangular cross-section and are penetrated in a longitudinal direction by a channel whose cross-sectional shape is adjusted to a cross-section of said rib-shaped projections.

4. The electroplating barrel of claim 3, further comprising a sealed metal core, inserted into said channel.

5. The electroplating barrel of claim 1, wherein a perforated wall part of said shell elements, which is disposed between said rib-shaped projections, is outwardly curved about an axis which is parallel to said barrel axis.

6. The electroplating barrel of claim 5, further comprising transverse braces formed on an outside of said shell elements which bridge a separation between said rib-shaped projections.

7. The electroplating barrel of claim 6, wherein each front end of said shell elements is flush with one of said transverse braces.

8. The electroplating barrel of claim 1, wherein said shell elements are formed in one piece from one of a polymer and PUR.

9. The electroplating barrel of claim 1, wherein a perforated wall part of said shell elements is formed from one of a polymer and PUR and said rib-shaped projections are formed from another thermoplastic material.

10. The electroplating barrel of claim 1, wherein said rib-shaped projections are made from polyethylene.

11. The electroplating barrel of claim 1, wherein said rib-shaped projections are made from polypropylene (PP).

12. The electroplating barrel of claim 1, further comprising plastic barrel front walls formed of sector-shaped front wall parts which are sidewardly connected to one another through gluing or cold-welding and form together a central bearing hub.

13. The electroplating barrel of claim 12, wherein said barrel front walls are formed of a number of said sector-shaped front wall parts corresponding to a number of said shell elements.

14. The electroplating barrel of claim 13, wherein said front wall parts are perforated at least over part of their wall surface.

15. The electroplating barrel of claim 12, wherein sides of said front wall parts have an integrally formed front rib-shaped projection, and neighboring front rib-shaped projections are glued or cold-welded to form radial ribs, wherein said radial ribs project radially outwardly beyond said front wall parts at a barrel periphery and cover said ribs, formed by said rib-shaped projections of said shell elements, at a front end of the barrel.

* * * * *